United States Patent [19]

Lack

[11] Patent Number: 4,561,329

[45] Date of Patent: Dec. 31, 1985

[54] LOW PROFILE RATCHET WRENCH

[75] Inventor: Larry H. Lack, Bossier City, La.

[73] Assignees: Frank M. Auer; C. J. Auer; Paul B. Lindenmayer, all of Shreveport, La.

[21] Appl. No.: 587,361

[22] Filed: Mar. 8, 1984

[51] Int. Cl.[4] ..... B25B 13/46

[52] U.S. Cl. ..... 81/62

[58] Field of Search ..... 81/61, 62, 63, 63.1, 81/63.2

[56] References Cited

U.S. PATENT DOCUMENTS 3,490,317 1/1970 Rozmus ..... 81/62

4,003,275 1/1977 Smith ..... 81/5729

4,475,420 10/1984 Atkinson et al. ..... 81/63

*Primary Examiner*—James L. Jones, Jr.

*Attorney, Agent, or Firm*—John M. Harrison

[57] ABSTRACT

A low profile ratchet wrench which includes a handle, a housing shaped in one end of the handle, a ratchet drum rotatably mounted in the housing and provided with external teeth and a recessed tang drive, and a ratchet mechanism positioned in the housing and selectively engaging the drum teeth to facilitate rotation of the ratchet drum in either the clockwise or counterclockwise direction responsive to rotation of the handle.

13 Claims, 5 Drawing Figures

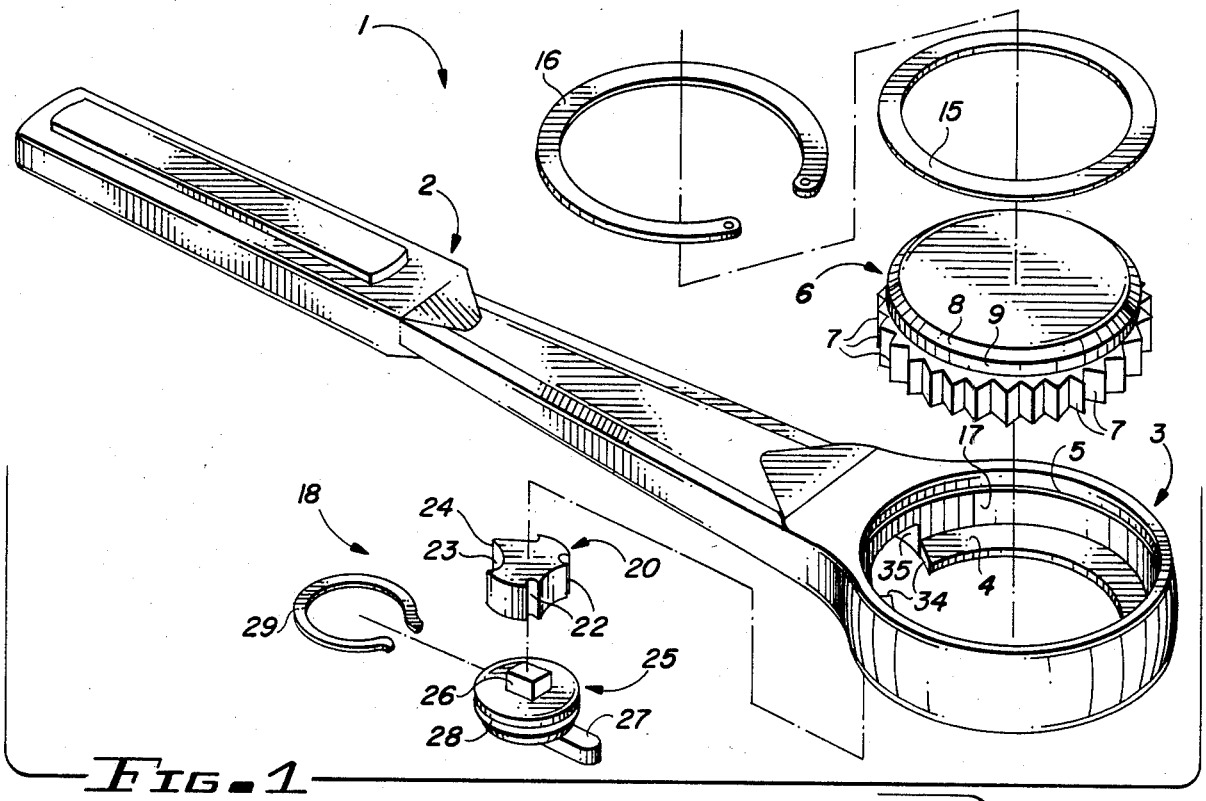
FIG. 1
FIG. 2
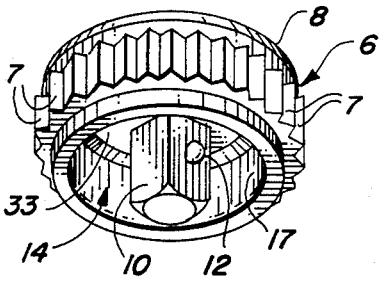
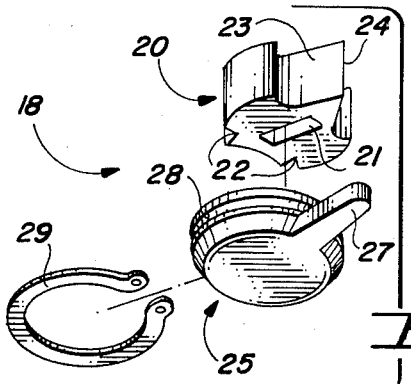
FIG. 5
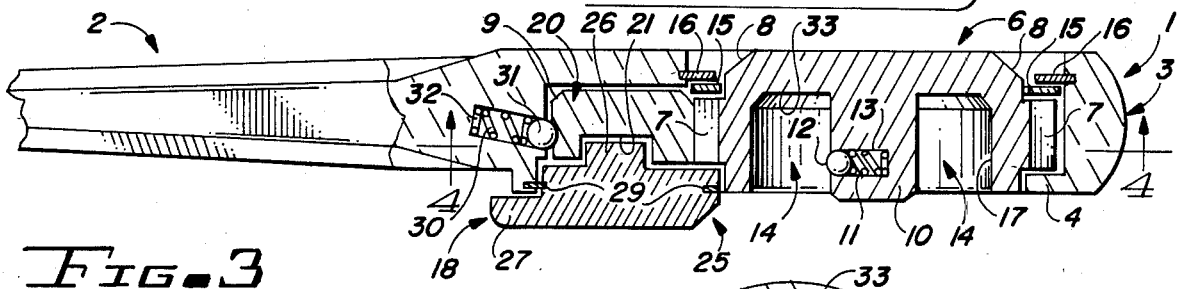
FIG. 3
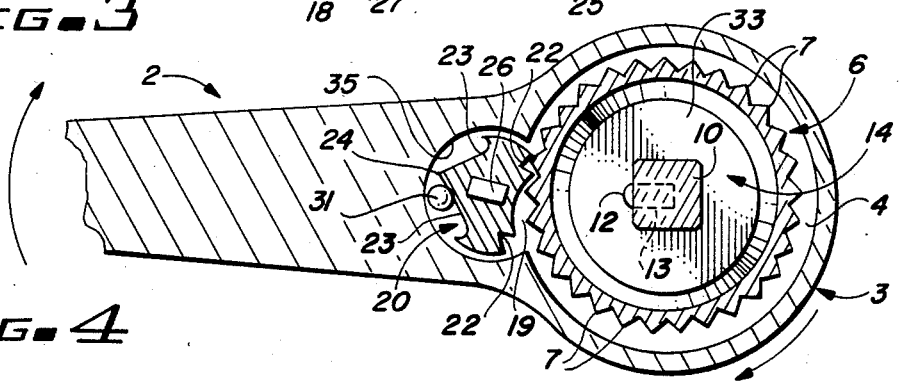
FIG. 4

LOW PROFILE RATCHET WRENCH

BACKGROUND OF THE INVENTION

1. Field of the Invention

This invention relates to wrenches having a ratcheting function and more particularly, to a ratchet wrench which is characterized by a relatively thin housing and a cooperating ratchet drum rotatably mounted in the housing and provided with a recessed tang drive. The recessed tang drive serves to recess the end of a conventional socket which is inserted on the tang drive and permits the socket and housing to fit into a smaller work space than is possible with conventional ratchet wrenches.

Ratchet wrenches have long been used for many purposes where bolts and nuts must be installed and removed in machines and equipment of various description. These wrenches feature a tang drive which is secured to a rotating drum and is driven by means of a ratchet mechanism which facilitates limited movement of the wrench handle. Such wrenches use conventional sockets of various size which are fitted with a drive receptacle compatible with the tang drive on the rachet drum for ease of replacement. These wrenches are particularly useful in small work spaces where the wrench handle is afforded only limited movement when engaging a nut or bolt, and the bolt or nut cannot therefore be easily unthreaded. The ratcheting function in the wrench serves to facilitate rapid removal of nuts and bolts under circumstances where the work spaces surrounding the nuts and bolts are sufficiently large to accommodate both the wrench housing and the socket mounted on the tang drive.

2. Description of the Prior Art

Wrenches having ratchet mechanisms which facilitate selective movement of a tang drive in either the clockwise or counter-clockwise direction by manipulation of the wrench handle have long been known and used in the art. Typical of these wrenches is the socket ratchet wrench having a handle with a housing provided at one end, which housing receives a rotating drum carrying a tang drive and provided with external splines for engagement by a ratchet pawl, the position of the pawl determining the direction of drive rotation of the tang drive. The ratchet pawl is typically operated by manipulating a pin or cap to selectively engage and disengage the pawl to and from the drum splines, respectively, and facilitate rotation of the tang drive in either the clockwise or the counter-clockwise direction, as desired. An early ratchet wrench is disclosed in U.S. Pat. No. 12,198, dated Jan. 9, 1855, to Charles G. Everitt, and includes a handle, a housing and a ratchet rotatably fitted in the housing and a pawl for selectively engaging the ratchet. U.S. Pat. No. 2,404,092, dated July 16, 1946, to F. A. Reynolds, discloses a "Ratchet Mechanism" which includes a rotatable nut provided in cooperation with the tang drive to facilitate rotation of the tang drive in either direction while the handle of the wrench remains stationary.

The tang drive in ratchet wrenches is usually formed integrally with and projects outwardly of the rotating drum and sockets of various size which are provided with a drive aperture shaped to receive the tang drive are fitted to the tang drive and seat against the drum. Accordingly, a work space which will accommodate the ratchet wrench must be at least as wide as the socket which is secured to the wrench plus the width of the wrench housing. In many cases, the cramped quarters of an automobile engine or other machine will not permit use of conventional ratchet wrenches because of this combined thickness. This problem has been partially solved by using sockets having universal joints which facilitate engagement of the socket with a bolt head or a nut under circumstances where the socket cannot be perfectly aligned with the bolt head or nut. However, use of such specialized sockets still requires access to the bolt head or nut in a work space which will accommodate the wrench housing and the attached socket.

Accordingly, it is an object of this invention to provide a wrench of the ratcheting design which includes a recessed tang drive facilitating use of conventional sockets in a work space which is too small to accommodate a conventional ratchet wrench.

Another object of the invention is to provide a new and improved ratchet wrench which is characterized by an exceptionally low profile and greater driving power, in that the effective work thickness of the wrench housing and tang drive combination is less than that of a conventional ratchet wrench of comparable size and weight.

Yet another object of this invention is to provide an improved, low profile ratchet wrench which is characterized by a relatively thin housing and a ratchet drum rotatably mounted in the housing and further including a tang drive which is recessed in the ratchet drum to reduce the width of the housing and tang drive combination and facilitate use of the wrench in a small work space.

Still another object of this invention is to provide a new and improved ratchet which is easy to dismantle and reassemble and which includes a handle with a housing shaped in one end, a ratchet drum situated in the housing and fitted with external teeth or splines and provided with an internal recess containing a tang drive and further including a ratchet mechanism located rearwardly of the housing and designed to selectively engage the drum teeth or splines and rotate the tang drive in either the clockwise or the counter-clockwise direction, depending upon the direction of rotation of the handle.

A still further object of the invention is to provide a low profile socket ratchet wrench which is characterized by a housing, a handle extending from the housing, a ratchet drum having external teeth or splines and a ratchet mechanism for engaging the teeth, and a tang drive which is recessed in the drum, with an annular space provided between the tang drive and the drum wall to accommodate a conventional socket, the tang drive and socket selectively driven in either a clockwise or counter-clockwise direction, depending upon the direction of rotation of the handle and the position of the pawl in the ratchet mechanism.

SUMMARY OF THE INVENTION

These and other objects of this invention are provided in a ratchet wrench capable of accepting conventional sockets, which wrench is characterized by a low profile created by a ratchet drum having external splines or teeth for engagement with the pawl in a ratchet mechanism located rearwardly of and beneath the housing and further provided with a recessed tang drive and an annular space between the tang drive and the inside wall of the drum, which annular space facilitates partial recessing of a conventional socket mounted on the tang drive and reduces the work space needed to accommodate the wrench.

BRIEF DESCRIPTION OF THE DRAWING

The invention will be better understood by reference to the accompanying drawing, wherein:

FIG. 1 is an exploded view of a preferred embodiment of the low profile ratchet wrench of this invention;

FIG. 2 is a bottom perspective view of the ratchet drum illustrated in FIG. 1;

FIG. 3 is a wide view, partially in section, of the ratchet wrench illustrated in FIG. 1;

FIG. 4 is a sectional view of the ratchet wrench taken along line 4—4 in FIG. 3; and FIG. 5 is an exploded view of a preferred ratchet mechanism used in the low profile ratchet wrench.

DESCRIPTION OF THE PREFERRED EMBODIMENTS

Referring now to FIGS. 1 and 3 of the drawing, the low profile ratchet wrench of this invention is generally illustrated by reference numeral 1 and includes a handle 2, provided with a round housing 3 at one end. The housing 3 is hollow and a housing flange 4, interrupted at a pawl seat bore 35 to define flange ends 34, is provided in the inside wall 17 of the housing 3. A pawl seat bore 35 is machined or otherwise provided in the bottom of the handle 2 adjacent the housing 3 and communicates with the hollow interior of the housing 3, as illustrated. A housing groove 5 extends around the inside periphery of the inside wall 17 of the housing 3 and is spaced from the housing flange 4. A ratchet drum 6, having multiple drum teeth 7 on an outer peripheral surface, fits inside the housing 3, with a bottom planar face of the drum teeth 7 resting on the housing flange 4, as illustrated in FIG. 3. A drum bevel 8 is also provided in a drum shoulder 9, defined by a top planar face of the drum teeth 7. As illustrated in FIG. 2, a tang drive 10 is recessed in the ratchet drum 6 and the tang drive 10 extends from the recess base 33 of the ratchet drum 6 to create an annular recess 14, which extends from the tang drive 10 to the inside wall 17 of the ratchet drum 6. A tang spring 11 is transversely enclosed in a tang bore 13 provided in the tang drive 10 and a tang ball 12, biased by the tang drive spring 11, extends from the tang bore 13 partially into the recess 14, in order to secure a socket to the tang drive 10, as hereinafter described. As further illustrated in FIGS. 1 and 3 of the drawing the ratchet drum 6 is rotatably retained in the housing 3 by means of a ratchet drum ring 16, which engages the housing groove 5 provided in the inside wall 17 of the housing 3. The dust cover 15 is retained over the top planar face of the drum teeth 7 by the ratchet drum ring 16 and serves to prevent dirt and grease from accumulating on the drum teeth 7.

Referring now to FIGS. 1 and 3–5, in a most preferred embodiment of the invention a ratchet 18 is provided in cooperation with the handle 2 in order to implement the ratcheting function of the low profile ratchet wrench 1. The ratchet 18 includes a shaped pawl 20, which incorporates a pawl slot 21 extending into the pawl 20, as illustrated in FIG. 5. Spaced engaging slots 22 are located in the frontal area of the pawl 20 and span the pawl slot 21, for selectively engaging the drum teeth 7, as illustrated in FIG. 4. Slanted ball engaging surfaces 23, spaced by a blade 24, are also provided in the pawl 20 opposite the engaging slots 22, respectively. The pawl 20 fits loosely in the pawl seat bore 35 against the pawl seat 19, which terminates the pawl seat bore 35, as illustrated in FIG. 4. The plate tab 26 of the ratchet plate 25 registers with the pawl slot 21 to facilitate selective engagement of the engaging slots 22 with the drum teeth 7, as illustrated in FIGS. 3 and 4. A thumb tab 27 extends from the ratchet plate 25 in order to effect rotatable manipulation of the ratchet plate 25 and pawl 20.

In another preferred embodiment of the invention a groove [not illustrated] is provided in the wall of the pawl seat bore 35 and a cooperating plate groove 28 is located in the ratchet plate 25 in order to receive a plate ring 29, as illustrated in FIG. 3, to rotatably retain the plate tab 26 of the ratchet plate 25 in registration with the pawl slot 21 of the pawl 20. A handle bore 32 is also drilled or otherwise provided in the handle 2 in communication with the pawl seat bore 35 and a ratchet spring 30, seated in the handle bore 32, serves to bias a ratchet ball 31 into contact with a selected one of the ball engaging surfaces 23 of the pawl 20.

In operation, and referring again to FIG. 4 of the drawing when the ratchet 20 is manipulated into a first position with a first engaging slot 22 engaging one of the drum teeth 7, the ratchet drum 6 and tang drive 10 can be driven in the clockwise direction by rotation of the handle 2 in the clockwise direction, as indicated by the arrows. The ratcheting action occurs when the handle 2 is driven in the counter-clockwise direction, since the engaged engaging slots 22 are permitted to successively disengage the drum teeth 7 as the ratchet ball 31 is recessed into the handle bore 32 against the bias of the ratchet spring 30, responsive to rearward pressure exerted by the ball engaging surface 23 which is resting against the ratchet ball 31. Rotation of the ratchet drum 6 and tang drive 10 in a counter-clockwise direction opposite to that indicated by the arrows in FIG. 4 is effected by manipulating the ratchet plate 25 to engage the opposite engaging slot 22 of the pawl 20 with one of the drum teeth 7 and rotating the handle 2 in the counter-clockwise direction. This position of the pawl 20 also facilitates an opposite ratcheting action of the handle 2 and ratchet drum 6 and allows the pawl 20 to contact, but disengage the drum teeth 7 of the ratchet drum 6 as the handle 2 and housing 3 are manipulated in the direction of the arrows.

As heretofore described, a primary feature of the low profile ratchet wrench 1 is the reduced effective length of a conventional socket which is attached to the tang drive 10, which reduction is created by the recessed tang drive 10 and corresponding recess 14. As illustrated in FIG. 3, it will be appreciated that when a conventional socket (not illustrated) is fitted to the tang drive 10, the socket can be countersunk in the recess 14 up to the recess base 33, and thereby shortened by the countersunk depth. This expedient reduces the effective work space which must be available in order to effect tightening or removal of a bolt or nut which is engaged by the socket. It will be further appreciated that this mechanical advantage is enhanced by use of sockets which incorporate a universal joint, in situations where the available work space prohibits direct alignment of a rigid socket with the nut or bolt to be tightened or loosened.

Another advantage of the low profile ratchet wrench 1 is realized in the location of the ratchet 18 beneath and rearwardly of the housing 3, where the ratchet 18 effects minimum interference with the low profile of the ratchet drum 6 when a conventional socket is attached to the tang drive 10.

Yet another advantage of the low profile ratchet wrench 1 is lightness of weight for each tang drive size chosen, and the capability for substitution of various ratchet drums 6 having tang drives 10 of different sizes. For example, in the case of conventional ratchet wrenches, replacement of the ratchet drum 6 to change the size of the tang drive 10 is frequently difficult, and is sometimes impossible without special tools. However, referring again to FIG. 1 of the drawing, it will be appreciated that the ratchet drum 6 can be easily replaced by a second ratchet drum having a tang drive 10 of a different size, by removing the ratchet drum ring 16 and the dust cover 15, and then removing the ratchet drum 6 from the housing 3. The replacement ratchet drum 6 can then be installed in the housing 3 by reversing this procedure. Similarly, the pawl 20 can be easily removed from the pawl seat bore 35 by removing the plate ring 29 and the ratchet plate 25, as illustrated in FIGS. 1 and 5 of the drawing, to provide access to the pawl 20.

Referring again to FIG. 3 of the drawing it will be appreciated that in addition to the low profile advantage created by the recessed tang drive 10, additional power can be exerted against the handle 2 to loosen or tighten a bolt or nut engaged by a conventional socket which is secured to the tang drive 10. This power can be applied in the assurance that the socket will not slip from the bolt head or nut because the line of force or torque applied to the socket is closer by the depth of socket recess, to the bolt head or nut, than it is in a conventional ratchet wrench. As illustrated in FIG. 3, considering the line of force (not illustrated) to extend longitudinally through the handle 2 to the tang drive 10, it will be appreciated that this line of force is closer to a nut or bolt head engaged by a conventional socket which is attached to the tang drive 10, than it would be in a conventional ratchet wrench, by the depth of the recess 14.

While the ratchet drum ring 16 and plate ring 29 can be characterized by a spiral ring or other ring known in the art, in a most preferred embodiment both the ratchet drum ring 16 and plate ring 29 are "snap" rings having shaped ends fitted for engagement with a special tool for removal and insertion. This characterization of the ratchet drum ring 16 and plate ring 29 facilitates quick and easy removal of the ratchet drum 6 from the housing 3 and the pawl 20 and ratchet plate 25 from pawl seat bore 35, respectively. Furthermore, referring again to FIGS. 1, 2 and 4 of the drawing, while the ratchet drum 6 can be provided with splines instead of the drum teeth 7, use of the latter is preferred since a more positive engagement between the drum teeth 7 and the engaging slots 22 in the pawl 20 is facilitated.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A low profile ratchet wrench comprising:

(a) a handle and a substantially round housing provided on one end of said handle, said housing having a top surface and a bottom surface;

(b) a ratchet drum rotatably located in said housing, said ratchet drum having an external peripheral surface, drum teeth on at least a portion of said external peripheral surface, a hollow interior, a closed end substantially coextensive with said top surface and an open end opposite said closed end and substantially coextensive with said bottom surface of said housing;

(c) a tang drive carried by said closed end of said ratchet drum, said tang drive disposed substantially in the center of said hollow interior of said ratchet drum and extending from said closed end toward said open end; and (d) ratchet means provided in said handle adjacent said housing in selective engagement with said drum teeth, whereby engagement of said drum teeth in a selected orientation by said ratchet means causes rotation of said ratchet drum in a selected direction responsive to rotatable manipulation of said handle in said selected direction.

2. The low profile ratchet wrench of claim 1 wherein said ratchet means further comprises a pawl slidably positioned in said handle and a ratchet plate engaging said pawl and in rotatable cooperation with said handle, whereby selective manipulation of said ratchet plate causes said pawl to selectively engage said drum teeth in said ratchet drum.

3. The low profile ratchet wrench of claim 1 further comprising a first snap ring in cooperation with said housing for removably securing said ratchet drum in said housing.

4. The low profile ratchet wrench of claim 2 further comprising a second snap ring in cooperation with said ratchet plate and said handle for removably securing said ratchet plate and said pawl in said handle.

5. The low profile ratchet wrench of claim 2 further comprising:

(a) a first snap ring in cooperation with said housing for removably securing said ratchet drum in said housing; and (b) a second snap ring in cooperation with said ratchet plate and said handle for removably securing said ratchet plate and said pawl in said handle.

6. The low profile ratchet wrench of claim 2 further comprising bias means in said handle, said bias means contacting said pawl for urging said pawl against said drum teeth in a selected orientation.

7. The low profile ratchet wrench of claim 6 wherein said bias means further comprises a bore provided in said handle, a spring located in said bore and a ball seated against said spring, said ball contacting said pawl and further comprising:

(a) a first snap ring in cooperation with said housing for removably securing said ratchet drum in said housing; and (b) a second snap ring in cooperation with said ratchet plate and said handle for removably securing said ratchet plate and said pawl in said handle.

8. A low profile ratchet wrench comprising;

(a) a handle and a substantially round housing provided in one end of said handle, said housing having a top surface and a bottom surface;

(b) a generally cylindrically shaped ratchet drum rotatably disposed in said housing and a hollow interior provided in said ratchet drum, an end segment closing one end of said ratchet drum, said end segment substantially coextensive with said top surface, and an opening at the opposite end thereof, said opposite end substantially coextensive with said bottom surface of said housing and drum teeth provided in longitudinal orientation on an external peripheral surface of said ratchet drum;

(c) a tang drive extending substantially from the center of said end segment of said ratchet drum through said hollow interior toward said opening, said tang drive substantially defining a concentric recess inside said hollow interior of said ratchet drum;

(d) a pawl bore provided in said handle, said pawl bore communicating with the interior of said housing;

(e) a pawl slidably disposed in said pawl bore and provided with oppositely disposed engaging slots for selectively engaging said drum teeth on said ratchet drum; and (f) a ratchet plate emgaging said pawl and mounted in rotatable cooperation with said handle, whereby selective manipulation of said ratchet plate causes said engaging slots in said pawl to selectively engage said drum teeth on said ratchet drum.

9. The low profile ratchet wrench of claim 8 further comprising:

(a) a first snap ring in cooperation with said housing for removably securing said ratchet drum in said housing; and (b) a second snap ring in cooperation with said ratchet plate and said handle for removably securing said ratchet plate and said pawl in said handle.

10. The low profile ratchet wrench of claim 8 further comprising bias means in said handle, said bias means contacting said pawl for urging said pawl against said drum teeth in a selected orientation.

11. The low profile ratchet wrench of claim 10 wherein said bias means further comprises a bore provided in said handle, a spring located in said bore and a ball seated against said spring, said ball contacting said pawl and further comprising:

(a) a first snap ring in cooperation with said housing for removably securing said ratchet drum in said housing; and (b) a second snap ring in cooperation with said ratchet plate and said handle for removably securing said ratchet plate and said pawl in said handle.

12. The low profile ratchet wrench of claim 8 further comprising socket bias means in cooperation with said tang drive for securing a socket on said tang drive.

13. The low profile ratchet wrench of claim 11 further comprising socket bias means in cooperation with said tang drive for securing a socket on said tang drive.

* * * * *